United States Patent [19]

Heavner

[11] 3,949,874

[45] Apr. 13, 1976

[54] REINFORCED COLLAPSIBLE CONTAINER

[75] Inventor: Larry W. Heavner, Lisle, Ill.

[73] Assignee: Coronet Container Corporation, Lombard, Ill.

[22] Filed: Aug. 28, 1974

[21] Appl. No.: 501,237

[52] U.S. Cl. ..... 206/386; 108/55; 108/56; 229/23 C

[51] Int. Cl.[2] ..... B65D 19/00

[58] Field of Search..... 229/23 C, 23 A; 206/386; 108/51, 55, 56, 58

[56] References Cited

UNITED STATES PATENTS

| | | | |
|---|---|---|---|
| 3,026,015 | 3/1962 | Severn | 108/56 |
| 3,049,265 | 8/1962 | Moss, Jr. et al. | 206/386 |
| 3,481,808 | 12/1969 | Wilkins et al. | 229/23 C |
| 3,489,274 | 1/1970 | Hughes et al. | 206/386 |
| 3,708,861 | 1/1973 | Hickey | 206/386 |
| 3,756,498 | 9/1973 | Anderson | 229/23 C |
| 3,770,186 | 11/1973 | Kupersmit | 108/56 |
| 3,799,382 | 3/1974 | Munroe | 108/56 |

FOREIGN PATENTS OR APPLICATIONS

| | | | |
|---|---|---|---|
| 1,559,725 | 3/1969 | France | 229/23 C |

*Primary Examiner*—William I. Price
*Assistant Examiner*—Bruce H. Bernstein
*Attorney, Agent, or Firm*—Molinare, Allegretti, Newitt & Witcoff

[57] ABSTRACT

A reinforced, collapsible, reuseable bulk carton container. The container includes a first pair of opposite side walls and a second pair of opposite side walls. The walls are hingedly interconnected along their lateral upright edges. The first pair of walls are foldable along upright score lines, intermediate their opposite edges, so that the second pair of walls are movable from an open, spaced apart condition to a closed, closely adjacent condition. A bottom wall is hingedly interconnected to the lower edge of one of the second pair of walls and a rigid reinforcing frame is fixed to the underside of the bottom wall. The frame is characterized by a plurality of rigid frame members which are secured to the entire perimeter of the bottom wall to provide a particularly strong reinforcement for the bottom wall. Preferably, upright rigid members are secured to the walls at the four corners of the container to provide for upright rigidifying support for the container.

6 Claims, 12 Drawing Figures

REINFORCED COLLAPSIBLE CONTAINER

BACKGROUND OF THE INVENTION FIELD OF THE INVENTION and DESCRIPTION OF THE PRIOR ART This invention relates to a collapsible reuseable, bulk type container used for carrying heavy products, such as engine parts, and it particularly relates to such containers which are exceptionally well reinforced both in their bottom wall and in their side walls.

Bulk type, reuseable collapsible containers are shown, for example, in my U.S. Pat. No. 3,743,166 and in my U.S. patent application Ser. No. 471,312, filed May 20, 1974. Such containers are of a large size and, for example, may be 4 feet wide by 4 feet long, by 7 feet high. Because of the large size of these containers, it is important that they be collapsible so that when shipped empty, they are in a collapsed condition, so as to avoid taking up an excessive amount of storage or shipping space. When the containers are to be used, they are first opened or erected so that the parts to be shipped can be placed therein. The containers with the parts therein are shipped from one plant to another. After the goods are removed, the containers are collapsed and returned to the first plant for reuse.

The filled containers, normally must be lifted by fork lift trucks, because of their heavy weight and large size. In the construction shown in my prior designs, as shown in the above-mentioned patent and patent application, only one pair of edges of the bottom wall are reinforced. With particularly heavy loads, sometimes the bottom wall has a tendency to collapse as the fork lift, inserted into the openings intermediate the rigid skids, raises the container from the bottom wall.

In addition to the above problem, it is sometimes desirable to stack one of the bulk containers on top of the other. The containers of my earlier design relied primarily on the strength of the side walls of the erected container and at times would become damaged due to the weight of the container stacked thereabove.

In order to overcome the foregoing problems, the desirability of reinforcing the bottom wall and the side walls is important. In the construction of a suitable reinforced container, however, it is important that the container be of a simple and economical construction so as to not complicate the manufacturing of the container and permit manufacturing on a mass production basis. From the standpoint of the manufacturing of the container, it is preferred that containers be manufactured by using machines of the type shown in my copending U.S. patent application Ser. No. 436,870, filed Jan. 28, 1974, now U.S. Pat. No. 3,905,282, entitled "Process and Apparatus for Assembling a Bulk Container". Furthermore, while reinforcing the container along the bottom wall and vertically, it is still required for the container to be foldable into a substantially flattened or collapsed condition. Therefore, it is not simply a matter of reinforcing the container, but all of the foregoing conditions must be met in order to provide a suitable reinforced container.

SUMMARY OF THE INVENTION

It is therefore an important object of this invention to provide an improved, collapsible container for carrying quantities of heavy products, wherein the container is reinforced along the bottom wall by a rigid framework which provides support along the entire perimeter of the container, and yet the improved container is simple and economical in construction and the container remains readily collapsible.

It is also an object of this invention to provide a bulk carton container wherein vertical support is provided for the container by the use of upright rigid members which are secured to the walls of the container at the four corners thereof.

It is a further object of this invention to provide an improved container which includes a bottom wall support frame which supports the entire perimeter of the bottom wall and which utilizes upright support members at the corners of the container for providing vertical support therefor.

It is still another object of this invention to provide an improved collapsible reinforced container which is particularly adapted to have the forks of a fork lift truck lift the same.

Further purposes and objects of this invention will appear as the specification proceeds.

The foregoing objects are accomplished by providing a reinforced, collapsible, reuseable container, which includes a first pair of opposite side walls, a second pair of opposite side walls, each pair of walls being hingedly interconnected to the other pair along their lateral upright adjacent edges; the first pair of walls is simultaneously foldable along upright intermediate score lines, so that the second pair of walls may be moved from an open, spaced apart condition to a closed closely positioned condition; a bottom wall is hingedly interconnected to the lower edge of one of the second pair of walls; and a rigid reinforcing frame is rigidly secured to the underside of the bottom wall and the frame includes rigid frame members which are rigidly secured along the entire perimeter of the bottom wall. Furthermore, it is preferred to provide vertical support for the container by providing rigid upright members on the walls of the container at the four corners, defined at the hinged connections between the walls.

DETAILED DESCRIPTION OF THE DRAWINGS

Particular embodiments of the present invention are illustrated in the accompanying drawings wherein.

DETAILED DESCRIPTION OF THE PREFERRED EMBODIMENTS

Figure 1:
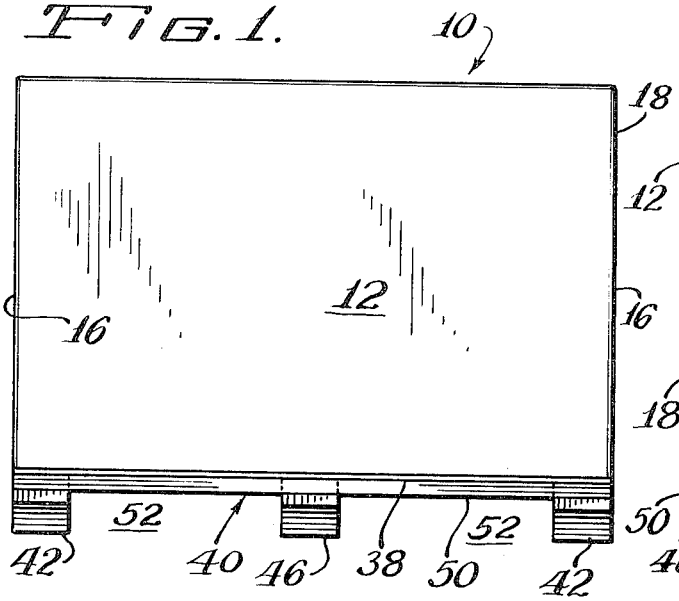
FIG. 1 is a side elevational view of one embodiment of my improved reinforced container.

Referring to FIGS. 1 – 6, a preferred form of my improved reinforced, heavy duty, container, generally 10, is shown. The container 10 includes a front wall 12, and a spaced rear wall 14. A pair of spaced end walls 16 are hingedly secured to the front wall 12 and rear wall 14 along four corners 18. In the embodiment shown, the front wall 12 is unitary with each of the end walls 16 while the rear wall 14 includes joining flaps 20 which are permanently bonded to each of the end walls 16 at the corners adjacent the rear wall 14.

The end walls 16 each include an upright score line 22 intermediate opposite edges 18. The score lines 22 permit the end walls 16 to be folded inwardly toward each other or outwardly away from each other, so as to permit collapsing of the container, and thereby move the front wall 12 into close proximity to the rear wall 14.

Preferably, the container 10 includes a top front flap 24, a top rear flap 26, and top end flaps 28, hingedly secured to the upper edges of the front wall 12, rear wall 14, and end wall 16, respectively. The end flaps 28 have score lines which are a continuation of the score lines 22 on the end walls 16 and thereby cooperate to permit the container to be collapsed as indicated previously. When the end flaps 28, front flap 24 and rear flap 26 are folded inwardly and downwardly, they define a cover for the goods stored within the container 10.

Figure 5:
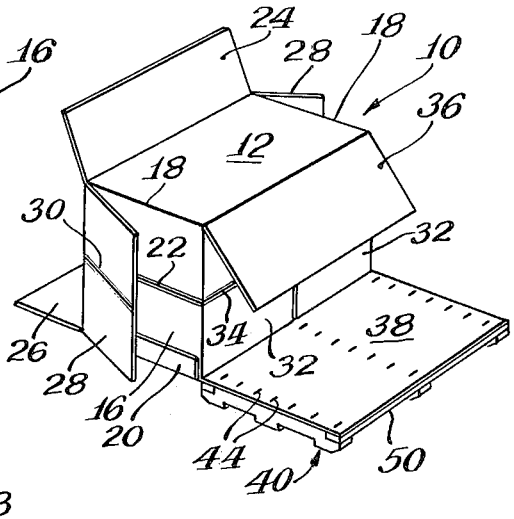
FIG. 5 is a pictorial view of a partially erected container of the type illustrated in FIGS. 1 – 4.

It is also desirable, for added strength, that there be bottom end flaps 32 hingedly secured to the lower edges of each of the end walls 16, as seen best in FIG. 5. Each of the bottom end flaps 32 includes a score line 34 which is aligned with both the score line 30 in the end flaps 28 and the score line 22 in the end wall 16. A bottom front flap 36 is hingedly secured to the lower edge of the front wall 12 and is foldable inwardly and on the outer surfaces of the bottom end flaps 32 as seen best in FIG. 5. A bottom wall 38 having the same length and width as the erected container 10 is hingedly secured to the lower edge of the rear wall 14 and is preferably unitary therewith.

The unique design of the container 10 is found in the frame assembly, generally 40, which is rigidly secured to the underside of the bottom wall 38. The frame assembly 40 includes a pair of rigid, preferably wood, frame members 42 which are rigidly secured to the opposite lateral ends of the bottom wall 38, as seen best in FIG. 4. Desirably, the frame members 42 are rigidly secured to the bottom wall 42 by an adhesive in addition to a plurality of staples or nails 44 which pass through the upper surface of the bottom wall 38 and rigidly engage the wood frame members 42. Additionally, it is desirable for the frame members 42, to have an intermediate frame member 46 positioned between the outer frame members 42 in order to provide central rigidity for the frame assembly 14.

Figure 2:
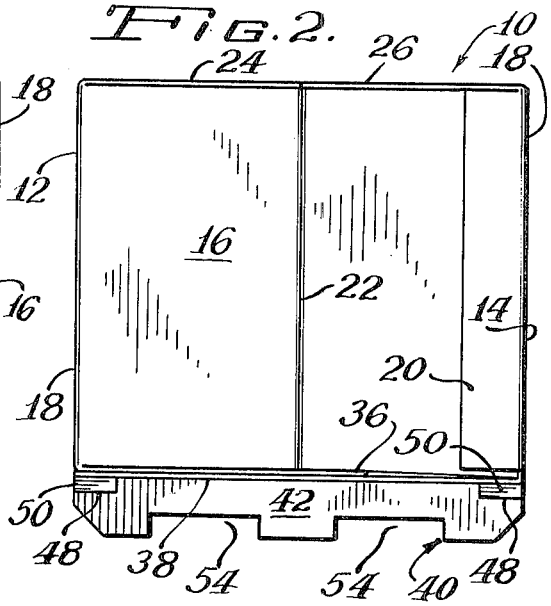
FIG. 2 is a side elevational view of the container illustrated in FIG. 1.
Figure 3:
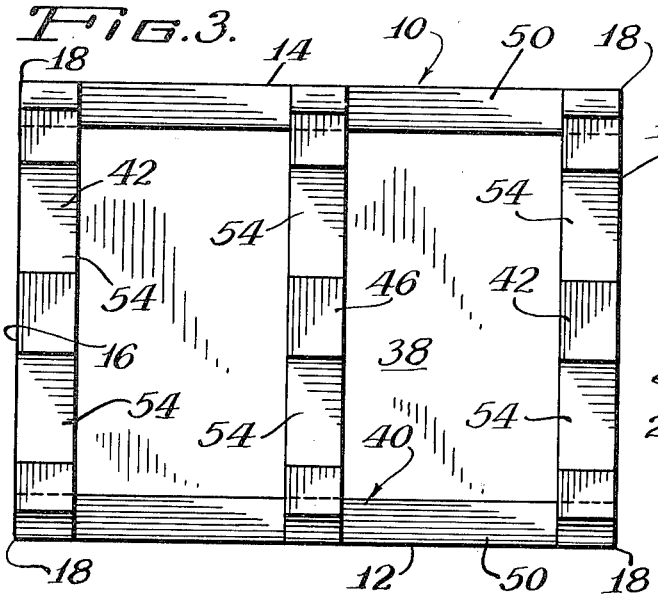
FIG. 3 is a bottom plan view of the reinforced container of FIGS. 1 and 2.
Figure 4:
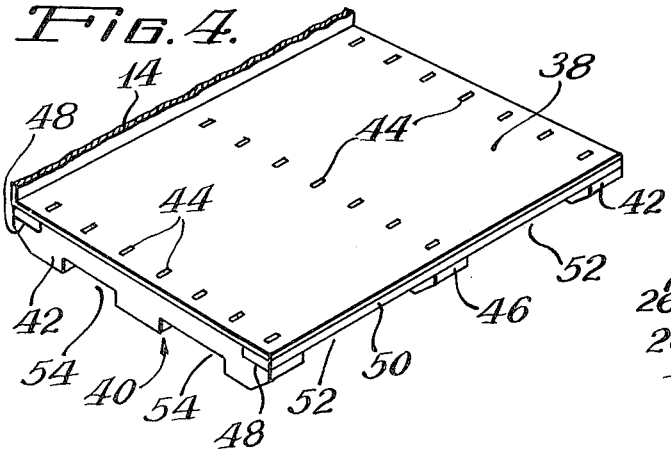
FIG. 4 is a fragmentary, pictorial view of the inside of the bottom wall of the container illustrated in FIGS. 1 – 3.
Figure 6:
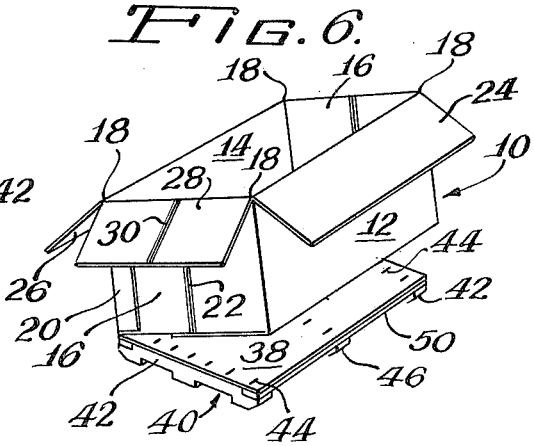
FIG. 6 is a pictorial view similar to FIG. 5, except showing the container as shown in the almost fully erected condition.

As seen best in FIGS. 1, 2, and 4, cut-out portions 48 are provided in the opposite upper ends of each of the rigid frame members 42 adjacent the outer surface of the bottom wall 38. Front and rear elongated, rigid frame members 50 are received within the aligned cut-out portions 48 in each of the frame members 42. The rigid frame members 50 are positioned along both the front and rear edges of the bottom wall 38.

It is seen that the elongated frame members cooperate with the frame members 42 in order to provide for additional rigidifying for the bottom wall along the entire perimeter thereof. The height of the elongated frame members 50 is substantially less than the height of the transverse frame members 46 so that space for receiving a fork (not shown) of a fork lift truck (not shown) is defined above the ground, below the frame members 50 and intermediate the frame members 42 and 46. Also, a pair of cut-out portions 54 are provided in spaced, bottom portions of the frame members 42 in order to accommodate the forks (not shown) of a fork lift truck (not shown). It is seen that the bottom wall 38, in the erected condition, includes a frame member 40 which provides rigid support for the bottom wall and also enables the fork lift to be inserted underneath the bottom wall 38 by being inserted through the cut-out portions 54 in a direction longitudinal of the container 10 or through the cut-out portions 48 in a direction transverse of the longitudinal axis of the container 10.

Figure 7:
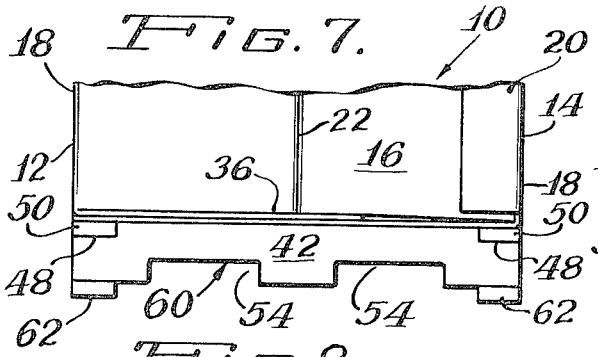
FIG. 7 is an alternate form for the bottom reinforcing frame construction used with a container of the type generally shown in FIGS. 1 – 6.
Figure 8:
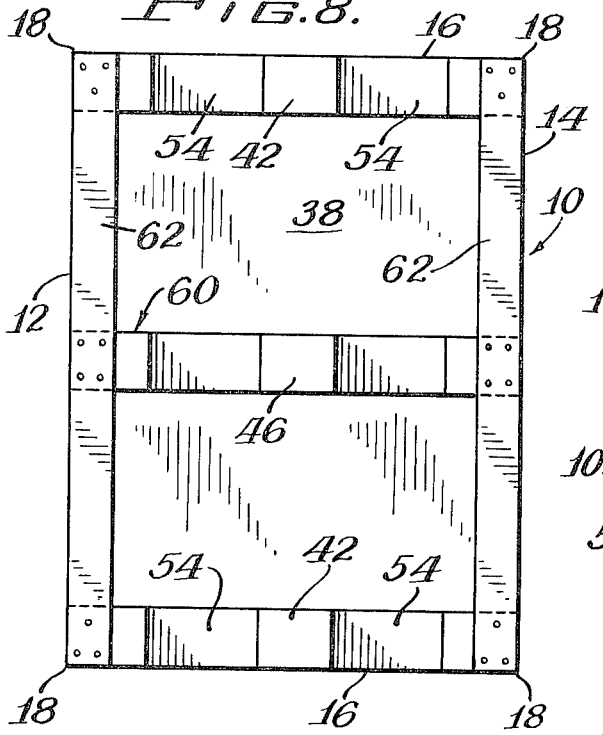
FIG. 8 is the bottom plan view of the alternate frame illustrated in FIG. 7.

Referring to FIGS. 7 and 8, there is shown an alternate embodiment of another preferred frame assembly 60. In the frame assembly 60, the container 10 includes the bottom wall 38, the rigid frame members 42 and the elongated frame members 50. In addition, a pair of elongated frame members 62 are positioned below the elongated frame members 50 and are rigidly secured to the outer surfaces of the opposite ends of the rigid frame members 42 in order to provided added rigidity for the frame assembly 40, while raising the container 10 further off the ground.

Figure 9:
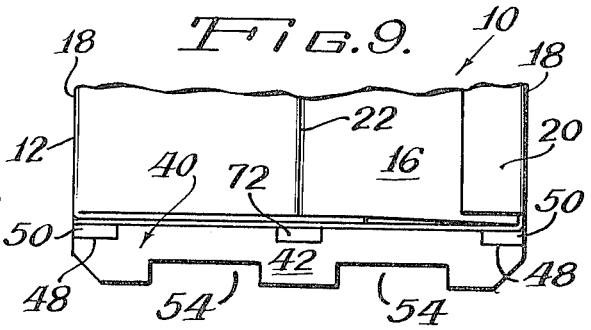
FIG. 9 is a side elevational view of still another alternate embodiment of the present invention utilizing a longitudinal, intermediate reinforcing strip on the bottom wall of the container.
Figure 10:
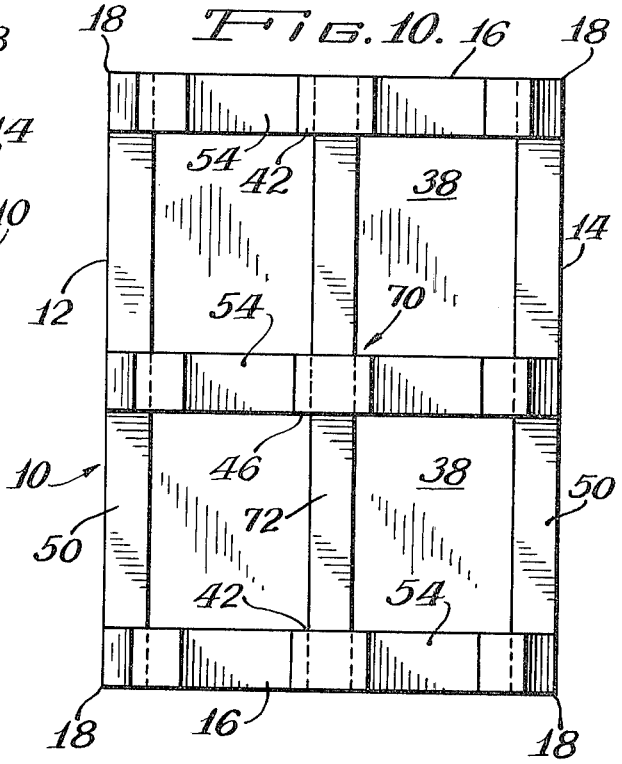
FIG. 10 is a bottom plan view of the alternate frame shown in FIG. 9.

Referring to FIGS. 9 and 10, there is shown another embodiment of a frame assembly 70 for use with the container 10. The frame assembly 70 is rigidly secured to the underside of the bottom wall 38. The shorter frame members 42 and the elongated frame members 50 are mounted along the perimeter, as previously described in the embodiment of FIGS. 1 – 6, 7 and 8. In addition, for greater rigidity an intermediate elongated frame member 72 is positioned between the frame members 50 and against the bottom wall 38.

Figure 11:
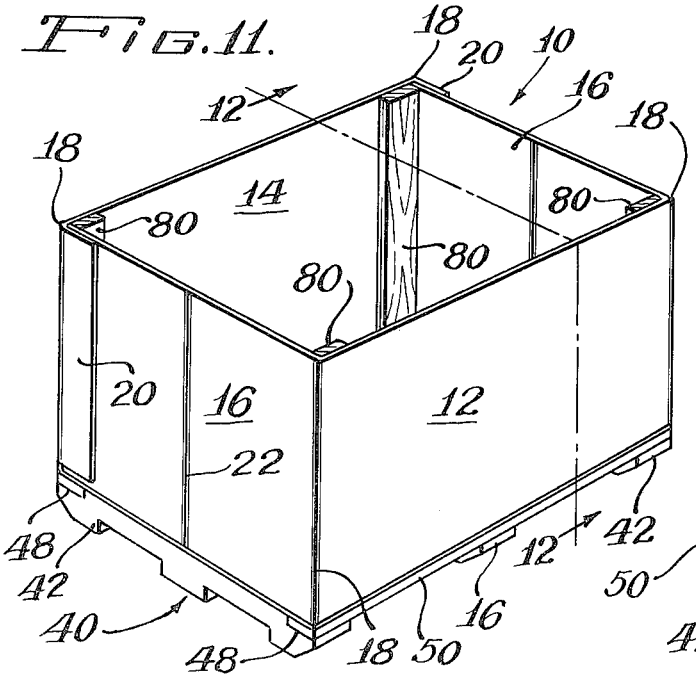
FIG. 11 is a pictorial view of still another alternate embodiment of the present invention wherein reinforcing strips are mounted in a vertical position at each of the four corners of the container so as to increase the vertical stacking strength of the container.
Figure 12:
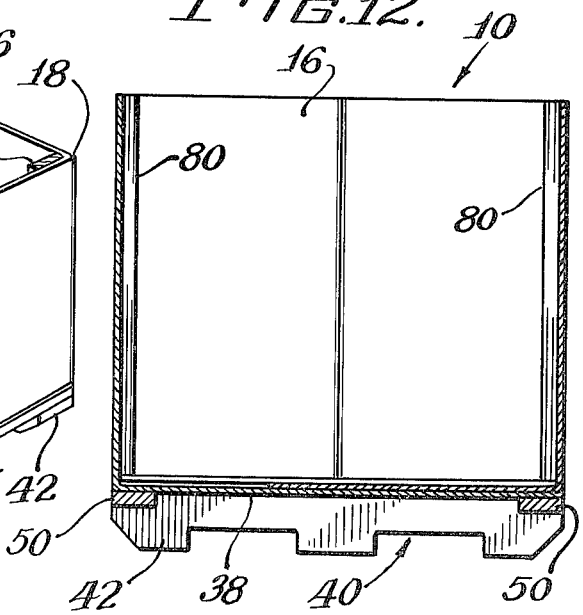
FIG. 12 is a sectional view taken along the line 12—12 of the container embodied in FIG. 11.

Referring to FIGS. 11 and 12, the container 10 shown therein is substantially the same as the embodiment of FIGS. 1 – 6. Additionally, the container 10 includes upright substantially vertical supports 80 which are securely mounted, as by an adhesive, along the inner surfaces of the front wall 12 and the rear wall 14. The upright supports 80 extend substantially along the entire inner surface of the container so as to greatly rigidify the corners 18 thereof. The supports 80 enable other containers to be stacked on top of the container 10 without any significant fear of damage to the lower container. It is important for the upright supports 80 to be over portions of the frame assembly 40 in order to cause the vertical supports 80 to substantially absorb most of the weight of the containers stacked thereabove, thereby substantially avoiding damage to the walls 12, 14 and 16 of the container 10.

It is seen from the foregoing, that I have provided an improved collapsible reuseable container 10 which is reinforced along the bottom wall 38 in such a way that there is substantially no risk that the bottom wall 38 will collapse when being lifted. Also, vertical supports 80 enable the containers 10 to be stacked one on the other without substantially risking damage to the side walls of the containers. The structure by which the container 10 is rigidified is simple and economical, and the assembly thereof is substantially the same as on a mass production basis with equipment such as the type shown in my pending application Ser. No. 436,870, referred to above. Also, the added reinforcement does not adversely affect the collapsability of the container.

While in the foregoing, there has been provided a detailed description of particular embodiments of the present invention, it is to be understood that all equivalents obvious to those having skill in the art are to be included within the scope of the invention as claimed.

What I claim and desire to secure by Letters Patent is:

1. A reinforced, collapsible, reuseable container, comprising, in combination, a first pair of opposed side walls, said walls being pivotally interconnected along lateral upright, adjacent edges thereof, said first pair of walls being simultaneously foldable so that said second pair of walls are movable from an open, spaced apart condition, to a closed, closely positioned condition, a bottom wall, said bottom wall being hingedly interconnected to the lower edge of one of said second pair of walls, and a rigid, reinforcing frame fixedly secured to the underside of said bottom wall, said frame including rigid frame members which are rigidly secured to the entire outer perimeter of said bottom wall for reinforcement thereof, said frame including a first pair of rigid frame members rigidly secured to the underside of said bottom wall along a first pair of opposite edges thereof, and a second pair of rigid frame members rigidly secured to the underside of said bottom wall along the other pair of opposite edges of said bottom wall, at least one of said pairs of rigid frame members being constructed and arranged to define a skid for raising the bottom wall of said container above ground level and for defining means for receiving forks of a fork lift, said fork lift receiving means including openings for receiving said forks both from a direction transverse to said first pair of walls and to said second pair of walls.

2. The container of claim 1 wherein a third frame member is interposed substantially intermediate said first pair of frame members and is rigidly secured to the underside of said bottom wall.

3. The frame of claim 1 including a third frame member interposed between said second pair of frame members and is rigidly secured to the underside of said bottom wall.

4. The container of claim 1 including a pair of frame members rigidly mounted below said first pair of rigid frame members, and on the underside of said first pair of rigid frame members.

5. The container of claim 1 including upright reinforcing members secured to said walls at each of the corners of said container, so as to provide for vertical rigidity for said container in the open condition.

6. The container of claim 5 wherein said upright rigid members are secured to the inner surfaces of said walls.

* * * * *